US010895832B2

(12) United States Patent
Takeuchi

(10) Patent No.: US 10,895,832 B2
(45) Date of Patent: Jan. 19, 2021

(54) IMAGE FORMING APPARATUS CAPABLE OF SUPPRESSING DAMAGE TO A FIXING MEMBER WHILE MAINTAINING PRODUCTIVITY

(71) Applicant: KYOCERA Document Solutions Inc., Osaka (JP)

(72) Inventor: Toshimitsu Takeuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/885,205

(22) Filed: May 27, 2020

(65) Prior Publication Data

US 2020/0379382 A1 Dec. 3, 2020

(30) Foreign Application Priority Data

May 31, 2019 (JP) ..... 2019-102663

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2042; G03G 15/2046
USPC ..... 399/67–69, 334
See application file for complete search history.

(56) References Cited

U.S. PATENT DOCUMENTS 8,509,645 B2 * 8/2013 Ikegami et al. ... G03G 15/2042 399/82
9,977,385 B2 * 5/2018 Miura et al. ..... G03G 15/2042
2017/0031279 A1 2/2017 Koyama

FOREIGN PATENT DOCUMENTS

JP 2001-282035 A 10/2001
JP 2007-298553 A 11/2007
JP 2017-32770 A 2/2017

* cited by examiner

*Primary Examiner* — William J Royer
(74) *Attorney, Agent, or Firm* — Stein IP, LLC

(57) ABSTRACT

An image forming apparatus includes an image forming unit, a fixing device, a temperature detection device, a driving device, a printed sheet number counting unit, a fixing voltage power supply, and a control unit. The fixing device includes a fixing member constituted of a heated rotary member heated by a heating device and a pressure member contacting the heated rotary member to form a fixing nip. The temperature detection device detects surface temperature of the heated rotary member in a non-passing area. The control unit changes a productivity in two or more steps from a default setting, on the basis of an accumulated number of printed sheets from start of a productivity change mode counted by the printed sheet number counting unit, and the surface temperature of the non-passing area detected by the temperature detection device, and changes control temperature of the fixing member in accordance with the productivity.

10 Claims, 4 Drawing Sheets

IMAGE FORMING APPARATUS CAPABLE OF SUPPRESSING DAMAGE TO A FIXING MEMBER WHILE MAINTAINING PRODUCTIVITY

INCORPORATION BY REFERENCE

This application is based upon and claims the benefit of priority from the corresponding Japanese Patent Application No. 2019-102663 filed May 31, 2019, the entire contents of which are hereby incorporated by reference.

BACKGROUND

The present disclosure relates to an image forming apparatus such as a copier or a printer including a fixing device that fixes a toner image transferred onto a recording medium. In particular, the present disclosure relates to a method for suppressing damage to a fixing member such as a fixing roller or a pressure roller, while maintaining productivity.

In a conventional electrophotographic image forming apparatus, the following image forming process is performed. First, an exposure device emits a laser beam onto an image carrier such as a photosensitive drum that is uniformly charged by a charging device, so as to form a predetermined electrostatic latent image in which the charge is partially reduced. Next, a developing device allows toner to be adhered to the electrostatic latent image so that a toner image is formed. After that, the toner image is transferred onto a paper sheet (recording medium) using transfer means, and the fixing device heats and presses the unfixed toner image so as to form a permanent image.

The fixing device is a device that melts the toner while conveying the paper sheet, using a fixing member constituted of a heated roller such as a fixing roller or a fixing belt and a pressure member such as a pressure roller. In recent years, as power saving standard has become stricter, power consumption is reduced by using low melting point toner, reducing heat capacity of the fixing member, or other method. As a method of reducing heat capacity of the fixing member, reduction of diameter or thickness of the roller is performed. As a heat source, a halogen heater is often used in consideration of cost or the like. In such a device, a plurality of heaters are used in many cases in view of higher speed. In this case, the heaters includes a main heater for securing temperature maintaining property in the middle part of the fixing roller when printing continuously, and a sub-heater for securing temperature rise characteristics at ends of the fixing roller in restoring operation.

However, if the size of the paper sheet to be fixing processed is small, a sheet passing area of the fixing member the paper sheet passes becomes low temperature because heat is deprived by the paper sheet from the surface of the fixing member, but a sheet non-passing area of the fixing member the paper sheet does not pass becomes high temperature. In particular, in continuous printing, when maintaining the sheet passing area of the fixing member at a fixing temperature (target temperature), the sheet non-passing area of the fixing member is overheated, which may cause a problem that temperature of the fixing member or the like becomes higher than a heat resistance limit temperature resulting in breakdown thereof. Specifically, temperature of a thermostat, which is provided to each heater in view of safety, may become higher than the operating temperature, so that power supply to the heater is stopped, and hence the temperature does not rise. Further, in a state where the sheet non-passing area is overheated, if a large-size paper sheet covering a high temperature part passes the fixing member, toner on the paper sheet may be excessively melted, adhered to the fixing member, and re-adhered to a paper sheet that passes next, which causes deterioration of image due to a hot offset or a thermal degradation of rubber constituting the pressure member.

Accordingly, various methods are proposed for suppressing overheating of the sheet non-passing area of the fixing device. For instance, there is known an image heating device, which includes a first temperature detection element for detecting temperature at a sheet passing part of a nip, a second temperature detection element for detecting temperature at a sheet non-passing part of the nip, and a control means for maintaining temperature at the sheet passing part, in which heating process conditions are set on the basis of an output of the first temperature detection element, an output of the second temperature detection element, and a size of the recording medium. Further, as setting of the heating process conditions, it is known to reduce the number of passing paper sheets or to change control temperature if a difference between detection temperatures of the first temperature detection element and the second temperature detection element is a predetermined value or lower and if the detection temperature of the second temperature detection element exceeds a certain temperature.

Further, there is known an image heating device and an image forming apparatus that increase feed interval of recording media so as to reduce productivity when a difference between temperature information about a recording medium passing area and temperature information about a recording medium non-passing area reaches a predetermined temperature difference, in which the temperature at which the productivity is reduced is changed in accordance with recording medium passing conditions. Further, there is known an image forming apparatus including a heating member and two sensors for detecting temperature of the heating member, in which if a temperature difference between the temperature sensors exceeds a threshold value a certain number of times, the number of image forming sheets per unit time is reduced or image formation on the recording medium is stopped, and the threshold value is increased as time elapses.

SUMMARY

An image forming apparatus according to one aspect of the present disclosure includes an image forming unit, a fixing device, a temperature detection device, a driving device, a printed sheet number counting unit, a fixing voltage power supply, and a control unit. The image forming unit forms a toner image on a recording medium. The fixing device is disposed on a downstream side of the image forming unit in a recording medium conveying direction, and includes a fixing member constituted of a heated rotary member heated by a heating device and a pressure member contacting the heated rotary member so as to form a fixing nip. The fixing device heats and presses the recording medium passing through the fixing nip so as to fix the toner image to the recording medium. The temperature detection device detects surface temperature of the heated rotary member in a non-passing area the recording medium does not pass. The driving device drives recording medium conveying members including the fixing member. The printed sheet number counting unit accumulates and counts the number of printed sheets. The fixing voltage power supply applies a voltage to the heating device. The control unit controls the driving device and the fixing voltage power supply. The control unit is capable of performing a productivity change mode for changing productivity as the number of printed sheets per unit time, by two or more steps from default setting, in accordance with a size of the recording medium. When performing the productivity change mode, the control unit changes the productivity in two or more steps from the default setting, on the basis of the accumulated number of printed sheets from start of the productivity change mode counted by the printed sheet number counting unit, and the surface temperature of the non-passing area detected by the temperature detection device, and changes control temperature of the fixing member in accordance with the productivity.

Other objects of the present disclosure and specific advantages obtained by the present disclosure will become more apparent from the description of the embodiment given below.

DETAILED DESCRIPTION

Figure 1:
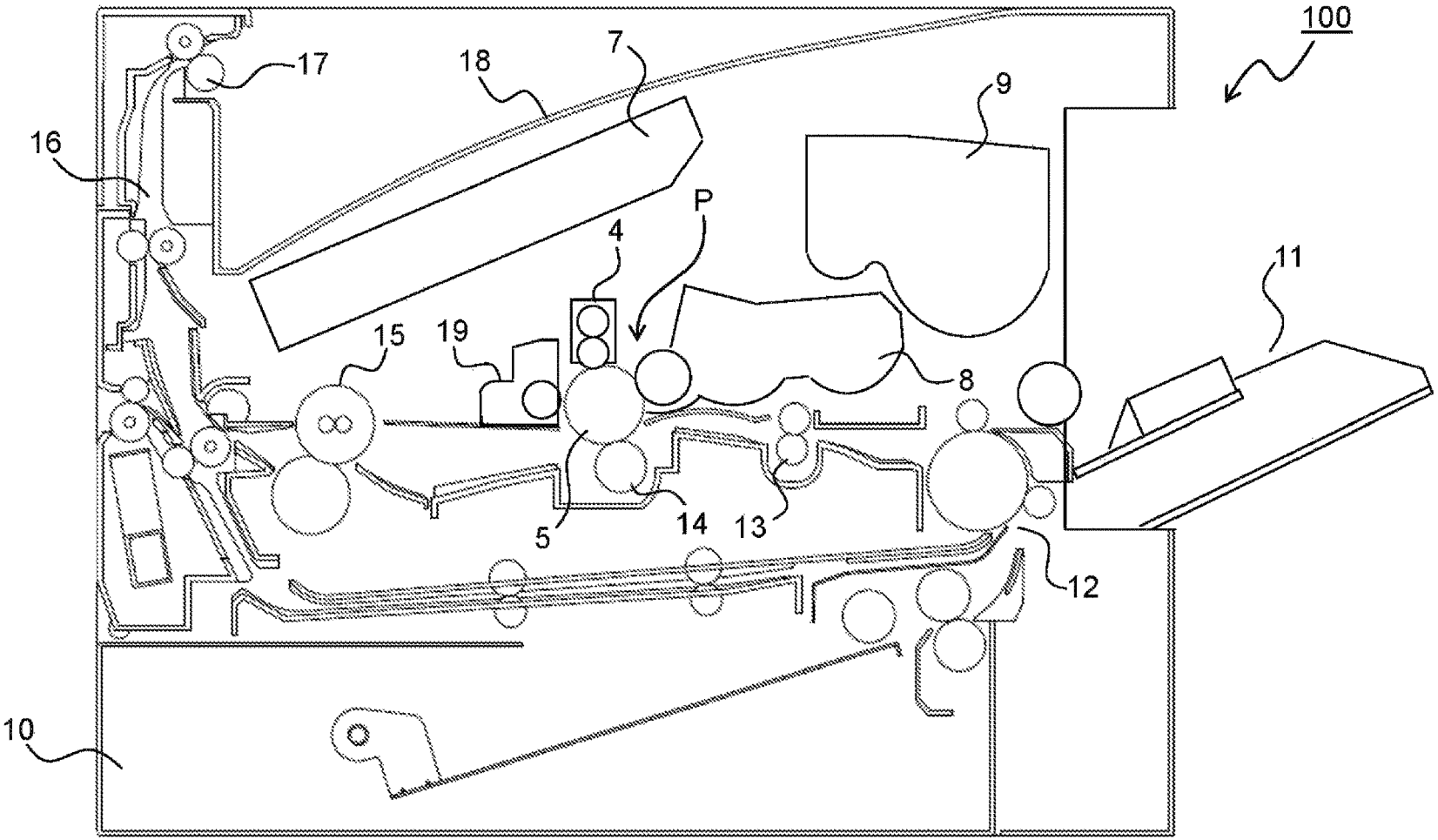
FIG. 1 is a cross-sectional side view of an image forming apparatus according to an embodiment of the present disclosure.

Hereinafter, with reference to the drawings, an embodiment of the present disclosure is described. FIG. 1 is a cross-sectional side view of an image forming apparatus 100 according to an embodiment of the present disclosure. In the image forming apparatus (such as a monochrome printer) 100, an image forming unit P is disposed, which forms a monochrome image by processes of charging, exposing, developing, and transferring. The image forming unit P includes a charging device 4, an exposure device (such as a laser scanning unit) 7, a developing device 8, a transfer roller 14, and a cleaning device 19, which are disposed along a rotation direction of a photosensitive drum 5 (a clockwise direction in FIG. 1).

When an image forming operation is performed, the surface of the photosensitive drum 5, which is rotated by a main motor (see FIG. 4) in the clockwise direction, is uniformly charged by the charging device 4. Further, a laser beam from the exposure device 7 based on document image data forms an electrostatic latent image on the photosensitive drum 5, and the developing device 8 allows developer (hereinafter referred to as toner) to be adhered to the electrostatic latent image, so that a toner image is formed. The toner is supplied to the developing device 8 from a toner container 9. Note that the image data is sent from a personal computer (not shown) or the like. Further, on the downstream side of the cleaning device 19 in the rotation direction of the photosensitive drum 5, a charge elimination device (not shown) is disposed for eliminating charge remaining on the surface of the photosensitive drum 5.

Toward the photosensitive drum 5 on which the toner image is formed as described above, a paper sheet (recording medium) is conveyed from a sheet feed cassette 10 or a manual sheet feeding tray 11 via a sheet conveying path 12 and a registration roller pair 13. Further, the transfer roller 14 (image transfer unit) transfers the toner image formed on the surface of the photosensitive drum 5 to the paper sheet. The paper sheet with the transferred toner image is separated from the photosensitive drum 5 and conveyed to a fixing device 15, in which the toner image is fixed. The paper sheet after passing through the fixing device 15 is conveyed along a sheet conveying path 16 to an upper part in the image forming apparatus 100, and is discharged by a discharge roller pair 17 onto a discharge tray 18.

Figure 2:
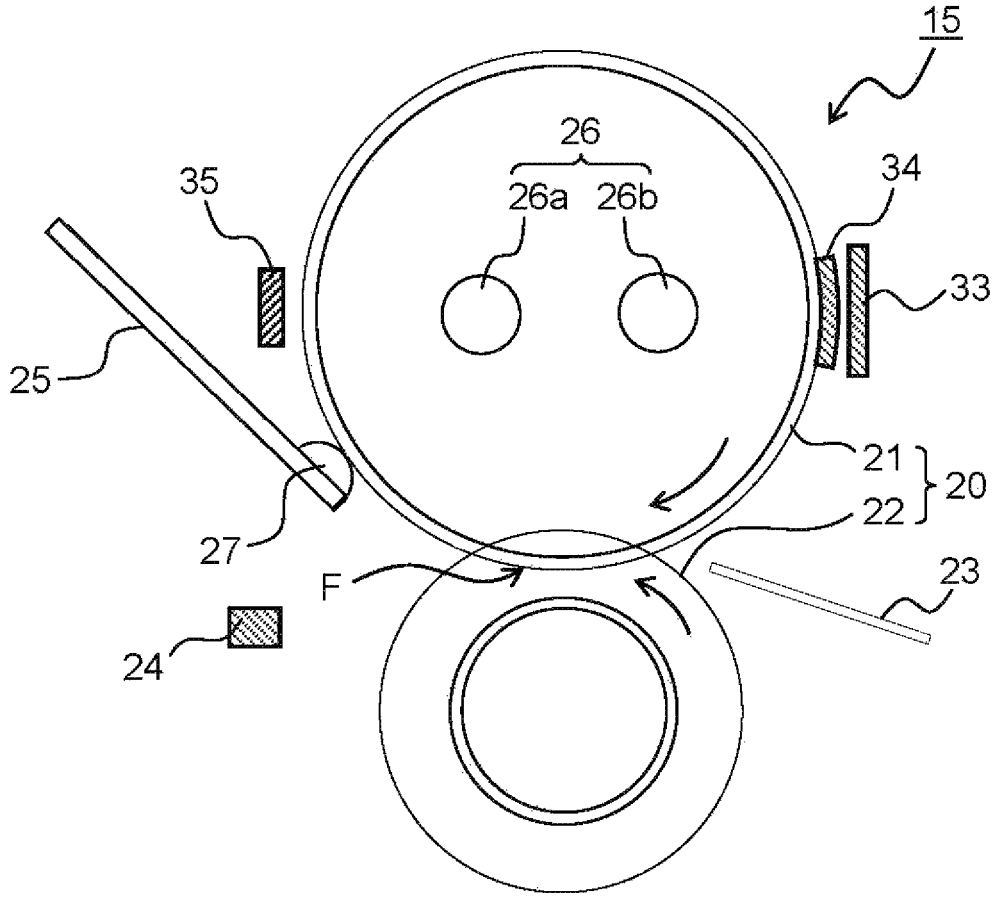
FIG. 2 is a cross-sectional side view of a fixing device mounted in the image forming apparatus.
Figure 3:
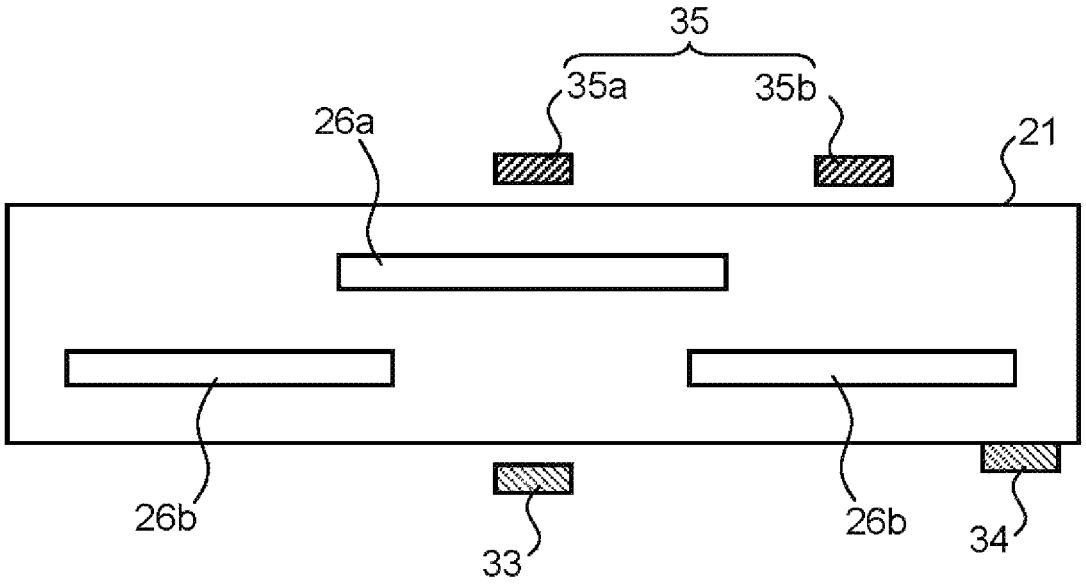
FIG. 3 is a cross-sectional plan view of a fixing roller of the fixing device of FIG. 2 viewed from above.

FIG. 2 is a cross-sectional side view of the fixing device 15 mounted in the image forming apparatus 100 of FIG. 1. FIG. 3 is a cross-sectional plan view of a fixing roller 21 of the fixing device 15 of FIG. 2, viewed from above. The fixing device 15 includes a fixing roller pair 20 (fixing member), a fixing entrance guide 23, a paper sheet detection sensor 24, a separation plate 25, a first temperature sensor 33 (temperature detection device), and a second temperature sensor 34 (temperature detection device). Note that a housing of the fixing device 15 is not shown in FIG. 2.

The fixing roller pair 20 is constituted of the fixing roller 21 (heated rotary member) rotated by a fixing drive motor 43 (see FIG. 4) in the clockwise direction in FIG. 2, and a pressure roller 22 (pressure member) driven by the fixing roller 21 to rotate in a counterclockwise direction. The pressure roller 22 is pressed to contact with the fixing roller 21 by a not-shown biasing means with a predetermined pressure to form a fixing nip F, so as to fix unfixed toner on the paper sheet passing through the fixing nip F.

As a structure of the fixing roller 21 used in this embodiment, there is one including a cylindrical aluminum core having a diameter of 30 mm, a thickness of 0.6 mm, and a crown amount (a diameter difference between middle and end in an axial direction) of 0.1 mm, and a coat layer (release layer) made of PFA resin (tetrafluoroethylene-perfluoroalkyl vinyl ether copolymer) formed on the circumference surface of the aluminum core, for example. Further, as a structure of the pressure roller 22, there is one including an aluminum core, a silicone rubber layer (elastic layer) formed around the aluminum core, and a PFA tube (release layer) covering the silicone rubber layer.

Inside the fixing roller 21, a heater 26 (heating device) is built in. The heater 26 is constituted of a main heater **26*a* of 600 W having a heat distribution peak in the middle in the axial direction of the fixing roller 21 (in the direction perpendicular to paper of FIG. 2), and a sub-heater 26*b* of 400 W having heat distribution peaks on both ends in the axial direction. Note that although a halogen heater is used as the heater 26 in this embodiment, another structure may be adopted in which an IH heater including an induction heating unit having an exciting coil and a core is used instead of the halogen heater, so as to heat the fixing roller 21** from outside.

On an upstream side of the fixing nip F in the paper sheet conveying direction (from right to left in FIG. 2), the fixing entrance guide 23 is disposed for guiding the paper sheet to the fixing nip F. Further, on the downstream side of the fixing nip F, the paper sheet detection sensor 24 is disposed for detecting passing of the paper sheet. The paper sheet detection sensor 24 is constituted of a fixing actuator protruding in the sheet conveying path so as to rock when the paper sheet passes and a photointerrupter (PI) sensor that is turned on or off when the fixing actuator rocks, for example.

On the downstream side of the fixing nip F in the rotation direction of the fixing roller 21 (clockwise direction), the separation plate 25 is disposed for separating the paper sheet from the fixing roller 21. The separation plate 25 is a plate-like member extending in the axial direction of the fixing roller 21 and separates the paper sheet after the fixing process from the surface of the fixing roller 21.

A pair of space limiting members 27 are fixed to an upstream side end part of the separation plate 25 in the paper sheet conveying direction (a lower right end part in FIG. 2) at both end edges in the width direction (in a direction perpendicular to paper of FIG. 2). The space limiting members 27 abut both ends of the outer circumference surface of the fixing roller 21 in the axial direction, and hence a space between the upstream side end part of the separation plate 25 and the surface of the fixing roller 21 is set to a predetermined space.

The paper sheet to which the toner image is transferred by the transfer roller 14 (see FIG. 1) proceeds to the left in FIG. 2, is conveyed into the fixing device 15 from an upstream side opening of the housing, and is guided along the fixing entrance guide 23 to the fixing nip F of the fixing roller pair 20. When passing through the fixing nip F, the paper sheet is heated and pressed at a predetermined temperature and pressure, so that the toner image on the paper sheet is made a permanent image. After that, the paper sheet is separated from the fixing roller 21 by the separation plate 25, is conveyed to the outside of the fixing device 15 through a downstream side opening of the housing, and is discharged to the outside of the image forming apparatus 100 by the discharge roller pair 17 (see FIG. 1).

On the upstream side of the fixing nip F in the rotation direction of the fixing roller 21, the first temperature sensor 33 and the second temperature sensor 34 are disposed, which are constituted of a thermistor or the like. The first temperature sensor 33 is disposed to face the middle part of the fixing roller 21 in the axial direction, so as to detect surface temperature of the fixing roller 21 in a non-contact state. The second temperature sensor 34 is disposed to contact one end part of the fixing roller 21 in the axial direction, so as to detect surface temperature of the fixing roller 21 in a contact state.

On the downstream side of the fixing nip F in the rotation direction of the fixing roller 21, a thermostat 35 is disposed. The thermostat 35 is constituted of a first thermostat 35*a* and a second thermostat 35*b*. The first thermostat 35*a* is disposed to face the middle part of the fixing roller 21 in the axial direction, and stops power supply to the main heater 26*a* when becoming a predetermined temperature or higher. The second thermostat 35*b* is disposed to face a part close to one end part of the fixing roller 21 in the axial direction, and stops power supply to the sub-heater 26*b* when becoming a predetermined temperature or higher.

Detection results of the first temperature sensor 33 and the second temperature sensor 34 are sent to a control unit 90 (see FIG. 4), and currents flowing in the main heater 26*a* and the sub-heater 26*b* are turned on and off, so that the fixing temperature is controlled. Further, on the basis of the detection result of the second temperature sensor 34, productivity of the image forming apparatus 100 is changed as described later.

Figure 4:
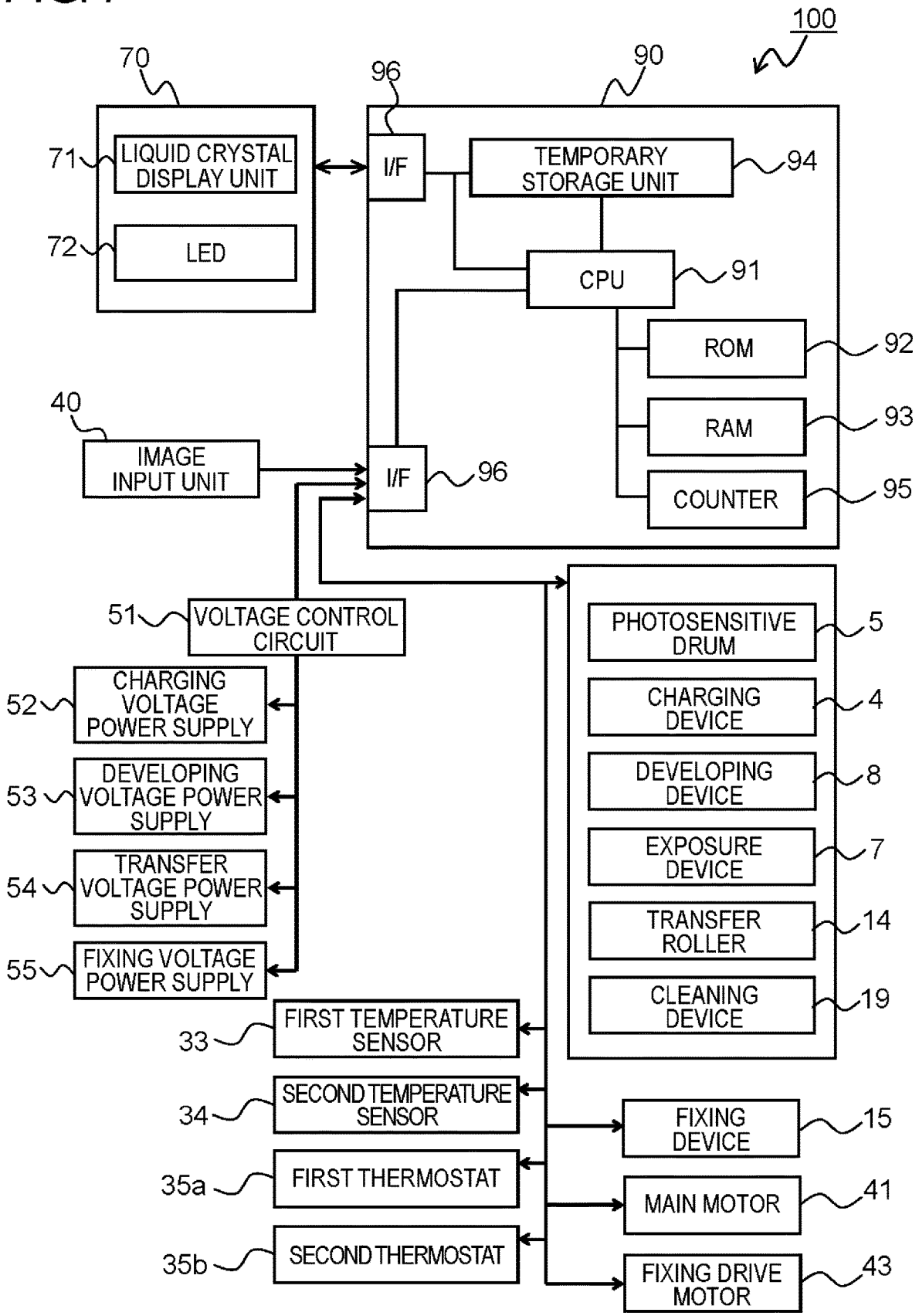
FIG. 4 is a block diagram illustrating one example of a control path of the image forming apparatus.

FIG. 4 is a block diagram illustrating a control path of the image forming apparatus 100. Note that when using the image forming apparatus 100, various controls of individual portions of the image forming apparatus 100 are performed, and hence the control path of the entire image forming apparatus 100 is complicated. Accordingly, in the control path, a part necessary for performing the present disclosure is mainly described. Further, a part that is already described is not described below.

An image input unit 40 is a receiving unit that receives image data sent from the personal computer or the like to the image forming apparatus 100. The image signal input from the image input unit 40 is converted into a digital signal and is sent to a temporary storage unit 94. A main motor 41 (driving device) drives the photosensitive drum 5 to rotate. The fixing drive motor 43 (driving device) drives the fixing roller 21 of the fixing device 15 to rotate.

A voltage control circuit 51 is connected to a charging voltage power supply 52, a developing voltage power supply 53, a transfer voltage power supply 54, and a fixing voltage power supply 55. The voltage control circuit 51 operates these power supplies by output signals from the control unit 90. Concerning these power supplies, on the basis of control signals from the voltage control circuit 51, the charging voltage power supply 52 applies a predetermined voltage to a charging roller in the charging device 4, the developing voltage power supply 53 applies a predetermined voltage to a developing roller in the developing device 8, the transfer voltage power supply 54 applies a predetermined voltage to the transfer roller 14, and the fixing voltage power supply 55 applies a predetermined voltage to the heater 26 in the fixing roller 21.

An operation unit 70 includes a liquid crystal display unit 71 and an LED 72 for indicating various statuses, so as to indicate a status of the image forming apparatus 100 and display an image forming status and the number of printed sheets. Various settings of the image forming apparatus 100 are made from a printer driver on the personal computer.

The control unit 90 includes at least a central processing unit (CPU) 91, a read only memory (ROM) 92 that is dedicated to reading, a random access memory (RAM) 93 that is readable and writable, the temporary storage unit 94 that temporarily stores image data and the like, a counter 95 (a printed sheet number counting unit), and a plurality of (two in this example) interfaces (I/Fs) 96 for sending control signals to devices in the image forming apparatus 100 and receiving an input signal from the operation unit 70.

The ROM 92 stores a control program for the image forming apparatus 100 and data such as numeric values necessary for control, which are not changed during operation of the image forming apparatus 100. The RAM 93 stores necessary data generated during control of the image forming apparatus 100, and data temporarily necessary for control of the image forming apparatus 100.

The temporary storage unit 94 temporarily stores the image signal that is input from the image input unit 40 and is converted into the digital signal. The counter 95 accumulates and counts the number of printed sheets.

As described above, when paper sheets of smaller size than the sheet passable area of the fixing roller pair 20 pass continuously, if a sheet passing area in the middle part of the fixing roller pair 20 in the axial direction is maintained at a fixing process temperature, sheet non-passing areas on both ends of the fixing roller pair 20 in the axial direction are overheated. As a result, temperature of the fixing roller 21 or the pressure roller 22 may become higher than a heat resistance limit temperature resulting in breakdown thereof. Further, if a large-size paper sheet passes immediately after small size paper sheets have passed continuously, a hot offset may occur, in which toner, which contacts both end parts of the fixing roller pair 20 in the axial direction, is adhered to the fixing roller pair 20 and is re-adhered to a paper sheet that passes next.

Accordingly, in the image forming apparatus 100 of this embodiment, when a small size paper sheet passes, a productivity change mode can be performed, in which productivity is decreased step by step so that overheating of the fixing roller pair 20 in the sheet non-passing area is suppressed.

Figure 5:
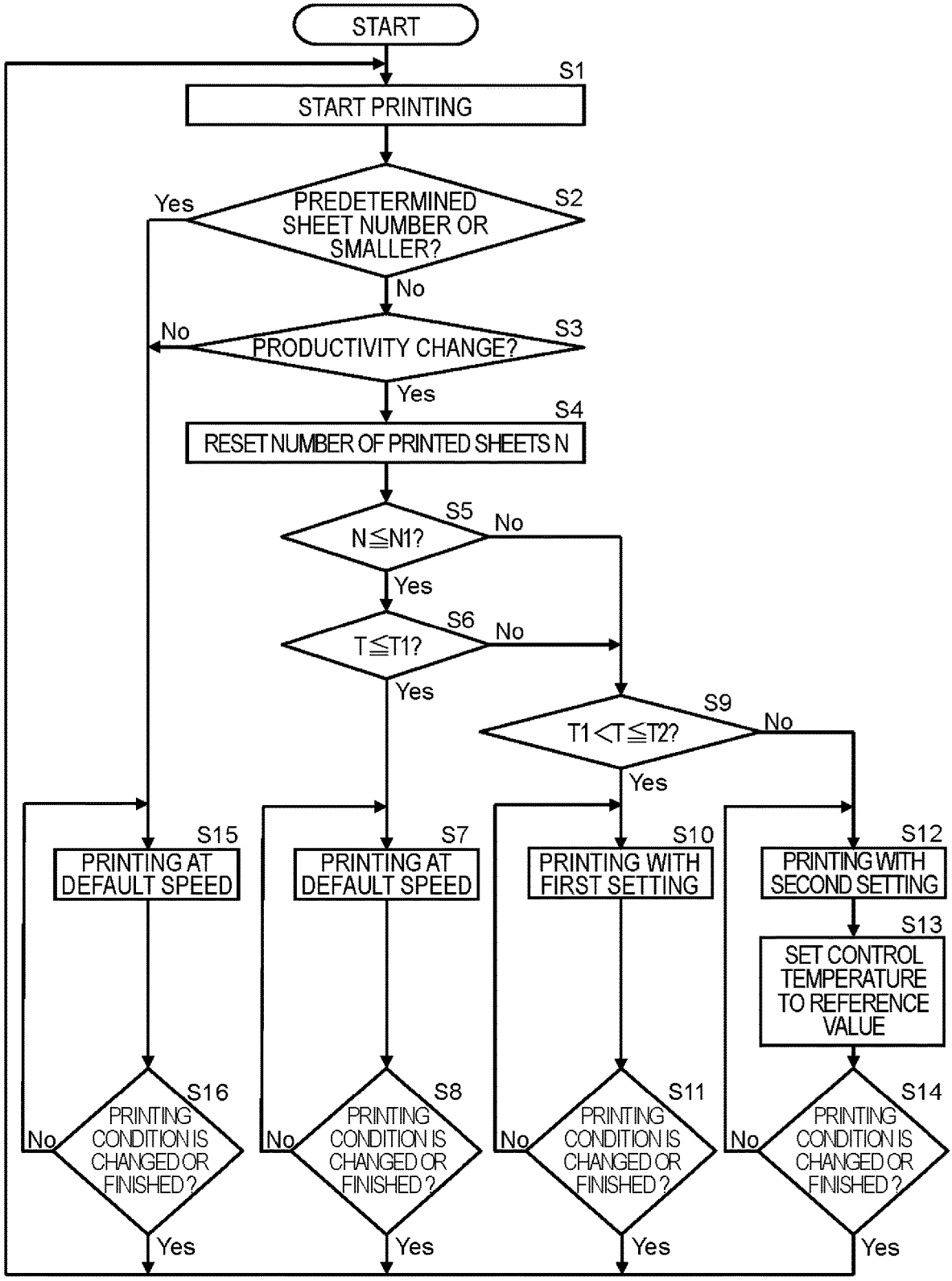
FIG. 5 is a flowchart illustrating an example of an execution control of a productivity change mode in the image forming apparatus according to this embodiment.

FIG. 5 is a flowchart illustrating an example of an execution control of the productivity change mode in the image forming apparatus 100 of this embodiment. With reference to FIG. 1 to FIG. 4, an execution procedure of the productivity change mode is described along to the steps of FIG. 5.

When a print start command is input from a host apparatus such as a personal computer (Step S1), the control unit 90 determines whether or not the input number of printing sheets is a predetermined number (e.g. 20) or smaller (Step S2). If the input number of printing sheets is larger than the predetermined number (No in Step S2), the control unit 90 determines whether execution of the productivity change mode is necessary or not on the basis of a paper sheet size (Step S3). The paper sheet size is detected by a paper sheet size detection sensor (not shown) disposed in the image forming apparatus 100 or is input from the operation unit 70 or the personal computer. Note that Step S2 is not necessarily required.

Specifically, when the paper sheet passes, which has a width direction size of a predetermined value or smaller and a conveying direction size of a predetermined value or larger, the productivity change mode is performed. This is because even if the width direction size of the paper sheet is a predetermined value or smaller, if its conveying direction size is small, heat of the sheet passing area is hardly deprived by continuous passing of the paper sheets, and hence it is not necessary to excessively heat by the heater 26, and overheat of the sheet non-passing area hardly occurs. For instance, if the passing paper sheet has a width direction size of 175 mm or smaller and a conveying direction size of 217 mm or larger, the productivity change mode is performed.

Furthermore, it may be possible to take into account not only the paper sheet size but also a basis weight (weight per unit area) of the paper sheet for determining whether or not to perform the productivity change mode. This is because even if the paper sheet has a width direction size of a predetermined value or smaller and the conveying direction size of a predetermined value or larger, if the paper sheet has a basis weight of a predetermined value or smaller, its heat capacity is so small that heat of the sheet passing area is hardly deprived by continuous passing of the paper sheets. For instance, if the passing paper sheet has a basis weight of 90 $g/m^2$ or larger, the productivity change mode is performed.

When performing the productivity change mode (Yes in Step S3), the control unit 90 resets the number of printed sheets N counted by the counter 95 (Step S4), and newly starts to count the number of printed sheets N.

Next, the control unit 90 determines whether or not the number of printed sheets N from start of the productivity change mode is a predetermined number N1 or smaller (Step S5). If $N \leq N1$ holds (Yes in Step S5), the control unit 90 determines whether or not surface temperature T of the sheet non-passing area detected by the second temperature sensor 34 is T1 or lower (Step S6). If $T \leq T1$ holds (Yes in Step S6), the control unit 90 controls to perform printing with default setting in which a line speed of convey rollers including the photosensitive drum 5, the fixing roller pair 20, the registration roller pair 13, and the discharge roller pair 17 (hereinafter referred to as a process line speed) is set to a default speed (Step S7). Note that the process line speed includes elements of at least a rotation speed of the convey rollers and an interval between sheets in continuous passing of the paper sheets.

Specifically, the control unit 90 sends a control signal to the fixing drive motor 43 to start driving the fixing roller pair 20 including the fixing roller 21 and the pressure roller 22 to rotate. At the same time, the voltage control circuit 51 and the fixing voltage power supply 55 start power supply to the heater 26, while the first temperature sensor 33 and the second temperature sensor 34 start detection of surface temperature of the fixing roller 21.

When detection temperature of the first temperature sensor 33 reaches a target temperature (fixing temperature), the paper sheet on which the toner image is formed by the image forming unit P passes the fixing nip F. The paper sheet is heated and pressed at a predetermined temperature and pressure, and the toner image on the paper sheet is made a permanent image.

After that, the control unit 90 determines whether or not a printing condition is changed or whether or not printing is finished (Step S8). If the printing condition is not changed and printing is continued (No in Step S8), the process flow returns to Step S7, and printing with the default setting is continued. If the printing condition is changed or printing is finished (Yes in Step S8) the process flow returns to Step S1, and a print command waiting state is continued. Note that in this control example, the number of printed sheets N is reset in Step S4 when the productivity change mode is started, but it may be reset when the printing condition is changed or when printing is finished.

In contrast, if $N > N1$ holds in Step S5 (No in Step S5), or if $T > T1$ holds in Step S6 (No in Step S6), the control unit 90 determines whether or not $T1 < T \leq T2$ holds (Step S9). If $T1 < T \leq T2$ holds (Yes in Step S9), the control unit 90 sends control signals to the main motor 41 and the fixing drive motor 43 so as to perform printing by changing to a first setting in which the process line speed is set to the default speed or lower (first step of decreasing productivity) (Step S10).

After that, the control unit 90 determines whether or not the printing condition is changed or whether or not printing is finished (Step S11). If the printing condition is not changed and printing is continued (No in Step S11), the process flow returns to Step S10, and printing with the first setting is continued. If the printing condition is changed or printing is finished (Yes in Step S11), the process flow returns to Step S1, and the print command waiting state is continued.

If $T > T2$ holds in Step S9 (No in Step S9), the control unit 90 sends control signals to the main motor 41 and the fixing drive motor 43 so as to perform printing by changing to a second setting in which the process line speed is lower than that in the first setting (second step of decreasing productivity) (Step S12). Further, when printing is performed with the second setting, the productivity is extremely reduced, and hence the fixing roller 21 is excessively heated. Therefore, in order to supply appropriate amount of heat to the fixing roller 21, the control temperature (target temperature) of the fixing roller 21 is set to a reference value (Step S13). The reference value means a basic control value without an increase in the control temperature due to environmental correction or continuous printing.

After that, the control unit 90 determines whether or not the printing condition is changed or whether or not printing is finished (Step S14). If the printing condition is not changed and printing is continued (No in Step S14), the process flow returns to Step S12, in which the productivity is set to the second setting, the control temperature of the fixing roller 21 is set to the reference value, and printing is continued. If the printing condition is changed or printing is finished (Yes in Step S14), the process flow returns to Step S1, and the print command waiting state is continued.

Further, when not performing the productivity change mode in Step S3 (No in Step S3), the productivity is set to the default setting and printing is performed (Step S15). After that, the control unit 90 determines whether or not the printing condition is changed or whether or not printing is finished (Step S16). If the printing condition is not changed and printing is continued (No in Step S16), the process flow returns to Step S15, in which the productivity is set to the default setting, and printing is continued. If the printing condition is changed or printing is finished (Yes in Step S16), the process flow returns to Step S1, and the print command waiting state is continued.

According to the control example described above, it is determined whether or not to perform the productivity change mode on the basis of a paper sheet size. If the paper sheet of a predetermined size passes, the productivity change mode is performed for changing the productivity. Therefore, overheating of the fixing roller 21 in the sheet non-passing area can be suppressed. Further, the productivity is changed on the basis of the number of printed sheets or an absolute value of temperature of the sheet non-passing area. Therefore, the productivity can be changed appropriately also in the fixing device 15 of a thermal roller fixing method illustrated in FIG. 2.

Further, the productivity is changed in three steps of the default setting, the first setting, and the second setting. Therefore, the productivity can be maintained as much as possible while suppressing overheating of the sheet non-passing area. Note that although the productivity is changed in three steps including the default setting in this example, the productivity may be changed in four or more steps in order to further improve the productivity.

Furthermore, when the productivity is decreased to the second setting, the control temperature (target temperature) of the fixing roller 21 is also decreased to prevent excessive heat supply by the heater 26, so that an appropriate amount of heat can be supplied. As a result, durabilities of the fixing roller 21 and the pressure roller 22 are improved, and longer lives of the fixing roller 21 and the pressure roller 22 can be achieved. Note that the control temperature of the fixing roller 21 is decreased when the productivity is decreased to the second setting in the control example described above, but the control temperature of the fixing roller 21 may be decreased also when the productivity is decreased to the first setting.

In the control example described above, the number of printed sheets N1 for changing the productivity is set only when printing with the default setting. When printing with the first setting or the second setting (when the productivity is decreased), the number of printable sheets with the productivity is not set. This is because depending on a paper sheet size, even if the second thermostat 35*b* (see FIG. 3) is heated higher than the operating temperature, there may be a case where temperature rises slowly in the sheet non-passing area (the right end part in FIG. 3) at which the second temperature sensor 34 is disposed, and a case should be considered where it cannot be determined whether or not the productivity should be decreased, only on the basis of the detection temperature of the second temperature sensor 34. Note that when the productivity is decreased, in order to avoid the problem due to the temperature rise in the sheet non-passing area, the productivity is changed only on the basis of the surface temperature of the sheet non-passing area.

Table 1 shows an example of the number of printed sheets N and the surface temperature T of the sheet non-passing area, to be a trigger for changing the productivity from the default setting to the first setting or the second setting.

TABLE 1

| productivity | number of printed sheets N | temperature T of sheet non-passing area |
|---|---|---|
| default setting | $N \leq 50$ | $T < 210$ |
| first setting | — | $210 \leq T < 220$ |
| second setting | — | $220 \leq T$ |

Although the number of printable sheets when the productivity is decreased is not set in Table 1, the following method may be adopted, for example. When printing in the first setting, an upper limit value of the number of printable sheets is set. When the number of printed sheets with the first setting reaches the upper limit value, even if the surface temperature T of the sheet non-passing area is lower than T2 (220° C. in this example), the productivity is decreased to the next step (the second setting).

Further, the default setting, the first setting, and the second setting used in the control example described above can be changed in accordance with the printing condition (single-sided printing, double-sided printing, full-speed mode, and half-speed mode). Therefore, as combinations of three productivity settings (the default setting, the first setting, and the second setting) and four modes of printing condition (the single-sided printing, the double-sided printing, the full-speed mode, and the half-speed mode), there are total 12 (3×4) modes. Table 2 shows an example of productivity settings. Note that the half-speed mode is a mode in which the paper sheet is conveyed at a speed that is ½ of a speed in the full-speed mode.

TABLE 2

| | full-speed mode | | half-speed mode | |
|---|---|---|---|---|
| productivity | single-sided printing | double-sided printing | single-sided printing | double-sided printing |
| first setting | faster one of (default setting) × 0.7 and 15 ppm | default setting | faster one of (default setting) × 0.7 and 15 ppm | default setting |
| second setting | slower one of (default setting) × 0.5 and 10 ppm | slower one of (default setting) × 0.5 and 10 ppm | slower one of (default setting) × 0.5 and 8 ppm | slower one of (default setting) × 0.5 and 8 ppm |

In Table 2, the default setting is set for each paper sheet size and for each printing condition. For instance, the default setting is set to 32 sheets/minute (32 ppm) for the full-speed mode and the single-sided printing, 23 sheets/minute (23 ppm) for the full-speed mode and the double-sided printing, 16 sheets/minute (16 ppm) for the half-speed mode and the single-sided printing, and 12 sheets/minute (12 ppm) for the half-speed mode and the double-sided printing.

Further, the setting of decreasing productivity is changed in accordance with being the full-speed mode or the half-speed mode, and being the single-sided printing or the double-sided printing. Here, the productivity setting of the single-sided printing and the double-sided printing can be changed in accordance with productivity information of the single-sided printing and the double-sided printing. For instance, in the setting described above, the productivity (23 ppm) of the default setting for the full-speed mode and the double-sided printing is the same as the first setting in the single-sided printing ((default setting)×0.7=32×0.7≈23 ppm), and hence, making much of the productivity in the double-sided printing, the first setting in the double-sided printing (the first step of decreasing productivity) is set as the default setting. The same is true for the first setting in the half-speed mode and the double-sided printing.

Further, the first setting in the single-sided printing is set to faster one of (default setting)×0.7 and 15 ppm. In this way, the set value is faster one of the fixed value (15 ppm) that does not vary according to a paper sheet size and the value obtained by multiplying the printing speed (default setting) set for each paper sheet size by the coefficient (0.7). Thus, even if the paper sheet size is one for which the default setting is a little slow, the productivity is maintained at the fixed value (15 ppm) at lowest, and hence excessive decrease in the productivity in the first setting can be prevented.

Further, the second setting (the second step of decreasing productivity) is set so that a margin can be secured for the surface temperature of the fixing roller 21 and the operating temperature of the thermostat for the heater 26 (slower one of (default setting)×0.5 and 10 ppm (or 8 ppm)). In this way, the second setting is set to slower one of the fixed value that does not vary according to a paper sheet size and the value obtained by multiplying the printing speed (default setting) set for each paper sheet size by the coefficient. Thus, even if the paper sheet size is one for which the default setting is a little high, the productivity can be decreased at least to the fixed value (10 ppm or 8 ppm), and hence fixing property and safety in the second setting of the lowest productivity can be secured.

Other than that, the present disclosure is not limited to the embodiment described above and can be variously modified within the scope of the present disclosure without deviating from the spirit thereof. For instance, the embodiment described above exemplifies the fixing device 15 of the thermal roller fixing method, in which the paper sheet with the unfixed toner image passes through the fixing nip F between the fixing roller 21 and the pressure roller 22, so that the toner is fixed. However, the present disclosure can also be applied to a fixing device of a belt fixing method, in which an endless fixing belt is provided instead of the fixing roller 21, and a paper sheet with an unfixed toner image passes through a fixing nip between the fixing belt and a pressure member pressed to contact the fixing belt, so that the toner is fixed.

Further, as a matter of course, without limiting to the monochrome printer illustrated in FIG. 1, the present disclosure can also be applied to other image forming apparatuses equipped with a fixing device, such as a color printer, a monochrome or color copier, a digital multifunction peripheral, and a facsimile machine.

The present disclosure can be used for a fixing device including a fixing member such as a fixing roller and a pressure roller. Using the present disclosure, it is possible to provide an image forming apparatus that can suppress damage to a fixing member of a fixing device due to overheating, and can maintain productivity at a certain level.

What is claimed is:

1. An image forming apparatus comprising:

an image forming unit for forming a toner image on a recording medium;

a fixing device disposed on a downstream side of the image forming unit in a recording medium conveying direction, the fixing device including a fixing member constituted of a heated rotary member heated by a heating device and a pressure member contacting the heated rotary member so as to form a fixing nip, the fixing device heating and pressing the recording medium passing through the fixing nip so that the toner image is fixed to the recording medium;

a temperature detection device for detecting surface temperature of the heated rotary member in a non-passing area the recording medium does not pass;

a driving device for driving recording medium conveying members including the fixing member;

a printed sheet number counting unit for accumulating and counting the number of printed sheets;

a fixing voltage power supply for applying a voltage to the heating device; and a control unit arranged to control the driving device and the fixing voltage power supply, wherein the control unit is capable of performing a productivity change mode for changing productivity as the number of printed sheets per unit time, in two or more steps from a default setting, in accordance with a size of the recording medium, and when performing the productivity change mode, the control unit changes the productivity in two or more steps from the default setting, on the basis of the accumulated number of printed sheets from start of the productivity change mode counted by the printed sheet number counting unit, and the surface temperature of the non-passing area detected by the temperature detection device, and changes control temperature of the fixing member in accordance with the productivity.

2. The image forming apparatus according to claim 1, wherein the control unit performs the productivity change mode, if a size of the recording medium in a width direction perpendicular to the recording medium conveying direction is a predetermined value or smaller, and if a size of the same in the recording medium conveying direction is a predetermined value or larger.

3. The image forming apparatus according to claim 2, wherein the control unit performs the productivity change mode if a basis weight of the recording medium is predetermined value or larger.

4. The image forming apparatus according to claim 1, wherein the default setting is set to different values for different sizes of the recording medium, and is set to different values between single-sided printing in which printing is performed only on one side of the recording medium and double-sided printing in which printing is performed on both sides of the recording medium.

5. The image forming apparatus according to claim 1, wherein the control unit is capable of changing the productivity to one of the default setting, a first setting in which the productivity is the default setting or lower, and a second setting in which the productivity is lower than the first setting, the control unit determines whether changing from the default setting to the first setting is necessary or not on the basis of the accumulated number of printed sheets or the surface temperature of the non-passing area, and the control unit determines whether changing from the first setting to the second setting is necessary or not on the basis of the surface temperature of the non-passing area.

6. The image forming apparatus according to claim 5, wherein when the control unit performs a double-sided printing in which printing is performed on both sides of the recording medium, the first setting is the same as the default setting.

7. The image forming apparatus according to claim 5, wherein the first setting is faster one of a value obtained by multiplying the default setting by a coefficient and a fixed value that does not vary according to a size of the recording medium.

8. The image forming apparatus according to claim 5, wherein the second setting is slower one of a value obtained by multiplying the default setting by a coefficient and a fixed value that does not vary according to a size of the recording medium.

9. The image forming apparatus according to claim 5, wherein the control unit changes the control temperature of the fixing member only when the productivity is changed to the second setting.

10. The image forming apparatus according to claim 5, wherein an upper limit value of accumulated number of printable sheets in the first setting is set, and when the accumulated number of printed sheets in the first setting reaches the upper limit value, the control unit changes to the second setting even if the surface temperature of the non-passing area is lower than a temperature at which changing to the second setting is necessary.

* * * * *